US008718498B2

(12) United States Patent
Nakayama

(10) Patent No.: US 8,718,498 B2
(45) Date of Patent: May 6, 2014

(54) IMAGE FORMING APPARATUS AND IMAGE FORMING METHOD FOR ADVANCED CONTROL OF IMAGE DENSITY

(75) Inventor: Masayoshi Nakayama, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 226 days.

(21) Appl. No.: 13/064,102

(22) Filed: Mar. 7, 2011

(65) Prior Publication Data

US 2011/0229173 A1 Sep. 22, 2011

(30) Foreign Application Priority Data

Mar. 17, 2010 (JP) ..... 2010-061585

(51) Int. Cl.
*G03G 15/00* (2006.01)

(52) U.S. Cl.
USPC ..... 399/49

(58) Field of Classification Search
USPC ..... 399/43, 49, 66, 298, 299, 302
See application file for complete search history.

(56) References Cited

U.S. PATENT DOCUMENTS

| | | | | |
|---|---|---|---|---|
| 6,295,435 | B1 * | 9/2001 | Shinohara et al. | 399/301 |
| 6,735,401 | B2 * | 5/2004 | Kajiwara et al. | 399/49 |
| 7,260,336 | B2 * | 8/2007 | Shimura et al. | 399/49 |
| 7,352,978 | B2 * | 4/2008 | Ebara et al. | 399/49 |
| 7,536,126 | B2 * | 5/2009 | Kawakami et al. | 399/49 |
| 7,548,704 | B2 * | 6/2009 | Hasegawa et al. | 399/49 |
| 7,986,891 | B2 * | 7/2011 | Yamamoto | 399/49 |
| 8,005,390 | B2 * | 8/2011 | Ramesh et al. | 399/72 |
| 8,107,837 | B2 | 1/2012 | Hirai | |

FOREIGN PATENT DOCUMENTS

| | | | |
|---|---|---|---|
| JP | 09-006123 | | 1/1997 |
| JP | 3422240 | | 4/2003 |
| JP | 3719372 | | 9/2005 |
| JP | 4575724 | B | 2/2006 |
| JP | 2006113540 | | 4/2006 |
| JP | 2007101890 | A * | 4/2007 |
| JP | 4283688 | B | 3/2009 |
| JP | 2009-198610 | | 9/2009 |
| JP | 2010-015110 | | 1/2010 |
| JP | 2010015110 | A * | 1/2010 |

OTHER PUBLICATIONS

Abstract of JP 11-184181 published on Jul. 9, 1999.
Abstract of JP 2005-202203 published on Jul. 28, 2005.
Abstract of JP 2001-337495 published on Dec. 7, 2001.
Abstract of JP 2006-047841 published on Feb. 16, 2006.
Office Action for corresponding Japanese patent application No. 2010-061585 dated Oct. 22, 2013.

* cited by examiner

*Primary Examiner* — Robert Beatty
(74) *Attorney, Agent, or Firm* — Harness, Dickey & Pierce, P.L.C.

(57) ABSTRACT

An image forming apparatus includes: an image forming unit that includes a developing unit with a developing roller to form an image using toner; a controller; and a detection unit that detects a plurality of toner patches formed at different densities on an image carrier by the image forming unit. The controller controls the image forming unit to form the toner patches on the image carrier so that each interval between the toner patches is equal to or greater than a length corresponding to a circumference length of the developing roller.

10 Claims, 7 Drawing Sheets

| TONER DENSITY (wt%) | 0 TO 50 | UP TO 200 | UP TO 400 | UP TO 600 | UP TO 800 |
|---|---|---|---|---|---|
| >8 | 2 | 2 | 3 | 3 | 3 |
| 7 TO 8 | 1 | 2 | 2 | 3 | 3 |
| 6 TO 7 | 1 | 1 | 2 | 2 | 3 |
| 5 TO 6 | 1 | 1 | 2 | 2 | 2 |
| 4 TO 5 | 1 | 1 | 1 | 2 | 2 |
| <4 | 1 | 1 | 1 | 1 | 2 |

IMAGE FORMING APPARATUS AND IMAGE FORMING METHOD FOR ADVANCED CONTROL OF IMAGE DENSITY

CROSS-REFERENCE TO RELATED APPLICATIONS

The present application claims priority to and incorporates by reference the entire contents of Japanese Patent Application No. 2010-061585 filed in Japan on Mar. 17, 2010.

BACKGROUND OF THE INVENTION

1. Field of the Invention

The present invention relates to an image forming apparatus such as electrophotographic copying machines, printers, or facsimiles, and an image forming method.

2. Description of the Related Art

Image forming apparatuses such as electrophotographic copying machines or laser beam printers perform what is called process control, in which control to adjust the density of images is conducted in order to provide stable image quality, for example, when the main power is turned on, during standby after a predetermined period of time has elapsed, or during standby after a predetermined or greater number of sheets have been printed. As a technique for making adjustment of an image density, for example, a technique disclosed in Japanese Patent Application Laid-open No. 2006-113540 is known.

The technique disclosed in Japanese Patent Application Laid-open No. 2006-113540 is conducted in the following steps to make adjustment of an image density. That is, first, the process develops a plurality of toner patches while varying the potential of development (the difference between developing bias and electric pattern potential), thus forming a gradation pattern of a plurality of toner patches at different densities on an image carrier such as an intermediate transfer belt. Then, the process causes an optical sensor to detect each toner patch of the gradation pattern formed on the image carrier, and calculates the amount of deposited toner of each toner patch using a predetermined algorithm on the basis of the value detected by the optical sensor. Then, on the basis of the relationship between the amount of deposited toner of each toner patch and the development potential at which each toner patch was formed, the process determines straight line equation $y=ax+b$. Thus, the process finds a development $\gamma$ (the slope "a" with the horizontal axis representing the development potential and the vertical axis representing the amount of deposited toner) and a development start voltage Vk (the intercept "b" with the horizontal axis representing the development potential and the vertical axis representing the amount of deposited toner). On the basis of the development $\gamma$ and the development start voltage Vk thus determined, the process adjusts image forming conditions such as the LD power, electrostatic charge bias, and developing bias, thereby allowing the development potential to provide an appropriate amount of deposited toner (i.e., image density).

However, according to the image density adjustment control disclosed in Japanese Patent Application Laid-open No. 2006-113540, the process continually develops a plurality of toner patches and therefore a toner patch is affected by the history of the just previously formed toner patch and made unstable when there occurs an effect of an image history at the pitch of the developing roller of the developing unit. This would lead to a problem that the process cannot accurately sense the development $\gamma$ and the development start voltage Vk, resulting in the controlled amount of deposited toner (image density) being made unstable. As used herein, the term "image history" refers to the phenomenon that, by the just previously formed image, next image is affected to thereby experience variations in density.

As a technique intended to reduce such an effect of the image history to properly make adjustment of an image density, for example, a technique disclosed in Japanese Pat. No. 3,719,372 is known. According to the technique disclosed in Japanese Patent No. 3719372, a plurality of toner patches are formed while the developing bias is being varied across the variable range. After that, the process forms a defective toner removal image and then the next image that has a width equal to or greater than the width of the toner patch in the main-scanning direction and a length equal to or greater than the circumferential length of the developing roller in the sub-scanning direction, before forming the next image. The technique disclosed in Japanese Patent No. 3719372 forms the defective toner removal image before forming a new image in this way in order to equalize the amount of electrostatic charge of the toner supplied from the developing roller and prevent the next image from being destabilized due to the effect of the image history.

Japanese Patent Application Laid-open No. 2006-47841 describes a configuration forming which a toner patch detectable by a specular reflection light-receiving section and a toner patch detectable by a diffuse reflection light-receiving section are formed and detected by an integrated specular and diffuse reflection sensor to sense the toner patches while switching between emission currents flowing through light emitters. Furthermore, the technique disclosed in Japanese Patent Application Laid-open No. 2006-47841 is configured to provide a gap between both the toner patches in order to detect one patch and control the current flowing through the light-emitting diode (LED) to thereby stabilize it and then detect the other patch.

However, the technique disclosed in Japanese Patent No. 3719372 is configured to form the defective toner removal image in order to reduce the effect of the image history. This causes a waste of toner in forming the defective toner removal image, leading to an increase in running costs.

Furthermore, the technique disclosed in Japanese Patent Application Laid-open No. 2006-47841 sets the intervals between patches without taking the effect of the image history into account. Japanese Patent Application Laid-open No. 2006-47841 does not describe specific intervals between patches, either.

SUMMARY OF THE INVENTION

It is an object of the present invention to at least partially solve the problems in the conventional technology.

According to an aspect of the present invention, there is provided an image forming apparatus including: an image forming unit that includes a developing unit with a developing roller to form an image using toner; a controller; and a detection unit that detects a plurality of toner patches formed at different densities on an image carrier by the image forming unit. The controller controls the image forming unit to form the toner patches on the image carrier so that each interval between the toner patches is equal to or greater than a length corresponding to a circumference length of the developing roller.

According to another aspect of the present invention, there is provided an image forming method including: causing, by a controller, an image forming unit to form a plurality of toner patches at different densities on an image carrier, the image forming unit including a developing unit with a developing roller to form an image using toner; and causing, by the controller, a detection unit to detect the toner patches formed on the image carrier by the image forming unit. The controller causes the image forming unit to form the toner patches on the image carrier so that each interval between the toner patches is equal to or greater than a length corresponding to a circumference length of the developing roller.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Now, referring to the accompanying drawings, a description will be made in detail to preferred embodiments of an image forming apparatus and an image forming method according to the present invention. The embodiment to be illustrated below is an example of a color laser printer to which the present invention is applied.

Figure 1:
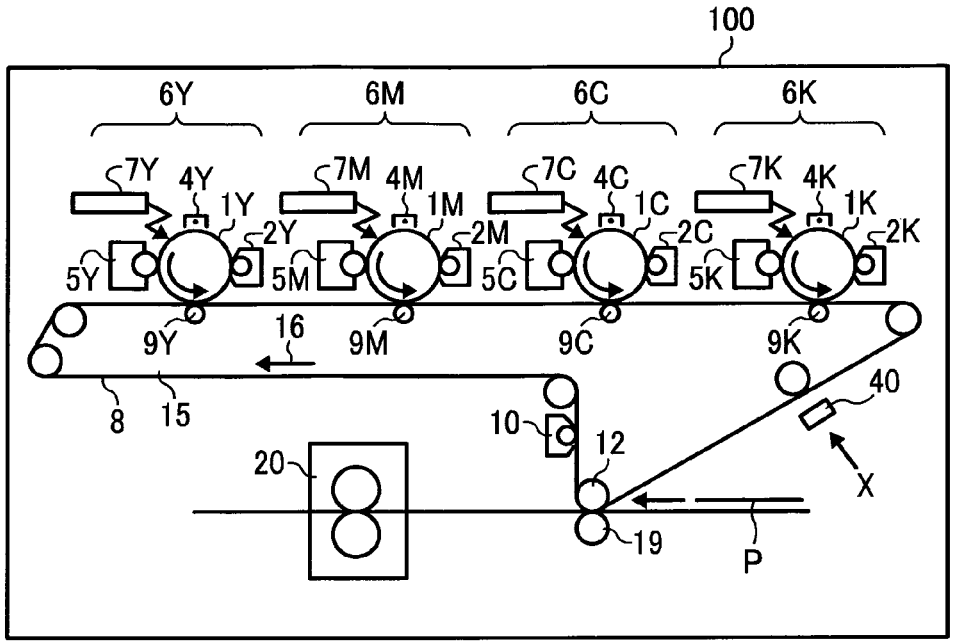
FIG. 1 is a schematic view illustrating the configuration of a color laser printer.

FIG. 1 is a schematic view illustrating the configuration of a color laser printer 100 according to the present embodiment. The color laser printer 100 includes four toner image forming sections 6Y, 6M, 6C, and 6K that creates toner images of respective colors: yellow, magenta, cyan, and black (hereinafter denoted as Y, M, C, and K). These four toner image forming sections 6Y, 6M, 6C, and 6K are configured in the same manner except that they employ mutually different color (Y, M, C, and K) toners as a developer.

For illustrations purposes, the toner image forming section 6Y that produces Y toner images will be taken as an example below. The toner image forming section 6Y includes a drum-shaped photosensitive element 1Y, a drum cleaning device 2Y, a discharging unit (not shown), a charging unit 4Y, and a developing unit 5Y. The charging unit 4Y electrostatically uniformly charges the surface of the photosensitive element 1Y that is driven to rotate counterclockwise in the figure by a driving unit (not shown). The surface of the photosensitive element 1Y that has been uniformly charged with the charging unit 4Y is exposed to and scanned with a laser beam, whereby a Y electrostatic latent image is formed. The Y electrostatic latent image is developed to a Y toner image by the developing unit 5Y that uses a Y toner. Then, the Y toner image developed by the developing unit 5Y is intermediate-transferred to an intermediate transfer belt 8. The drum cleaning device 2Y removes the toner remaining on the surface of the photosensitive element 1Y after having gone through the intermediate transfer step. Furthermore, the discharging unit eliminates residual charge on the photosensitive element 1Y after having been cleaned. This elimination of electrostatic charge initializes the surface of the photosensitive element 1Y to prepare for the next step of image formation.

Likewise, the other toner image forming sections 6M, 6C, and 6K form M, C, and K toner images on photosensitive elements 1M, 1C, and 1K, respectively, and the resulting toner images are intermediate-transferred to the intermediate transfer belt 8. Optical writing units 7Y, 7M, 7C, and 7K irradiate the respective photosensitive elements 1Y, 1M, 1C, and 1K of the toner image forming sections 6Y, 6M, 6C, and 6K with a laser beam emitted on the basis of image information for their exposure to the beam. This exposure to the beam causes Y, M, C, and K electrostatic latent images to be formed on the respective photosensitive elements 1Y, 1M, 1C, and 1K.

An intermediate transfer unit 15 is disposed below the toner image forming sections 6Y, 6M, 6C, and 6K in the figure. The intermediate transfer unit 15 mainly includes the intermediate transfer belt 8 that endlessly travels clockwise (in the direction of an arrow 16) in the figure, four primary transfer bias rollers 9Y, 9M, 9C, and 9K, and a cleaning device 10. The intermediate transfer unit 15 is also provided with a secondary transfer backup roller 12. The primary transfer bias rollers 9Y, 9M, 9C, and 9K and the photosensitive elements 1Y, 1M, 1C, and 1K sandwich the intermediate transfer belt 8 traveling endlessly in between to form respective primary transfer nips. This arrangement is designed to apply a transfer bias to the rear surface of the intermediate transfer belt 8 (the inner circumferential surface of the loop), in which the transfer bias has a polarity (for example, plus) opposite to that of the toner. Except the primary transfer bias rollers 9Y, 9M, 9C, and 9K, all the other rollers are electrically grounded.

In the course of the intermediate transfer belt 8 traveling endlessly through the Y, M, C, and K primary transfer nips, the Y, M, C, and K toner images on the respective photosensitive elements 1Y, 1M, 1C, and 1K are primarily transferred sequentially one on another. This allows for forming a four-color superimposed toner image (hereinafter referred to as the "four-color toner image") on the intermediate transfer belt 8. The secondary transfer backup roller 12 mentioned above and a secondary transfer roller 19 nip the intermediate transfer belt 8 in between to form a secondary transfer nip. The four-color toner image formed on the intermediate transfer belt 8 is transferred to a transfer sheet of paper P through the secondary transfer nip.

After having passed through the secondary transfer nip, the residual toner that was not transferred to the transfer paper sheet P is still deposited on the intermediate transfer belt 8.

The untransferred residual toner is cleaned with the cleaning device 10. At the secondary transfer nip, the transfer paper sheet P is sandwiched between the intermediate transfer belt 8 and the secondary transfer roller 19, surfaces of both of which travel in the forward direction, and transported. The transfer paper sheet P coming out of the secondary transfer nip is subjected to heat and pressure while passing through the rollers of a fixing unit 20, and thereby the transferred four-color toner image is fixed onto the surface of the transfer paper sheet P.

In FIG. 1, between the toner image forming section 6K positioned most downstream in the travelling direction of the intermediate transfer belt 8 and the secondary transfer nip portion, there is provided a reflective photo sensor 40 serving as a density detection unit opposite to the intermediate transfer belt 8. The reflective photo sensor 40 is designed to output a signal depending on the optical reflectivity of the surface of the intermediate transfer belt 8.

Figure 2:
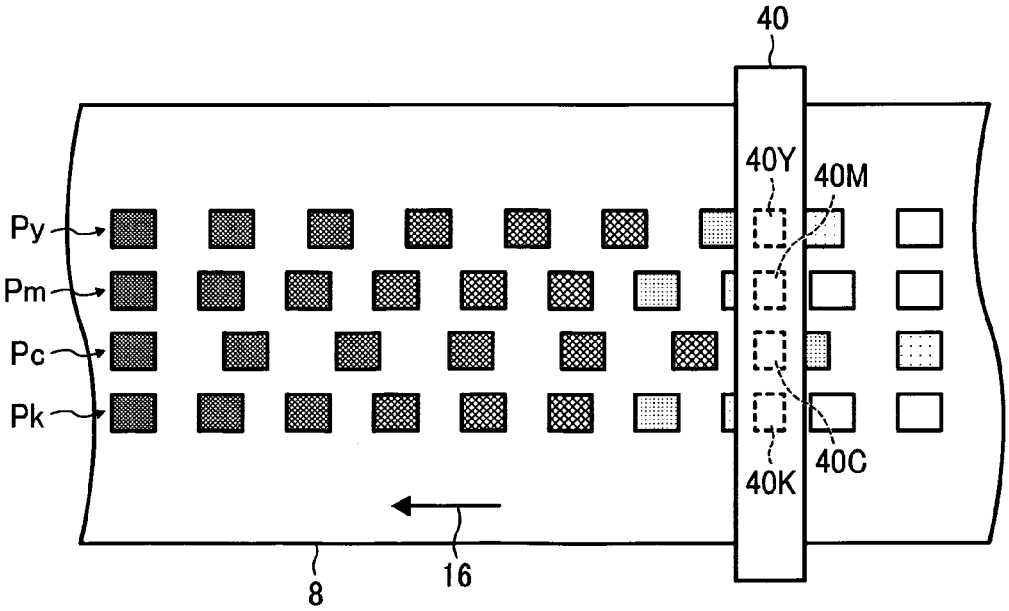
FIG. 2 is a view illustrating a portion where a reflective photo sensor is disposed, when viewed in the direction of X shown in FIG. 1.

FIG. 2 is a view illustrating the portion at which the reflective photo sensor 40 is disposed, when viewed in the direction of X of FIG. 1. The reflective photo sensor 40 includes color sensor sections 40Y, 40M, 40C, and 40K that each individually sense the density of the respective four color (Y, M, C, and K) toner patches formed on the intermediate transfer belt 8. These sensor sections 40Y, 40M, 40C, and 40K are arranged in an array in a direction perpendicular to the plane of FIG. 1 (i.e., in parallel to the travelling direction 16 of the intermediate transfer belt 8). In each of the sensor sections 40Y, 40M, 40C, and 40K of the reflective photo sensor 40, one selected from the diffused-light detection type sensor or the specular reflection detection type sensor is used, the selected one being able to provide a sufficiently great difference between the amount of reflected light from the surface of the intermediate transfer belt 8 and the amount of reflected light from each toner patch that constitutes gradation pattern Py, Pm, Pc, or Pk to be described later.

Figure 3:
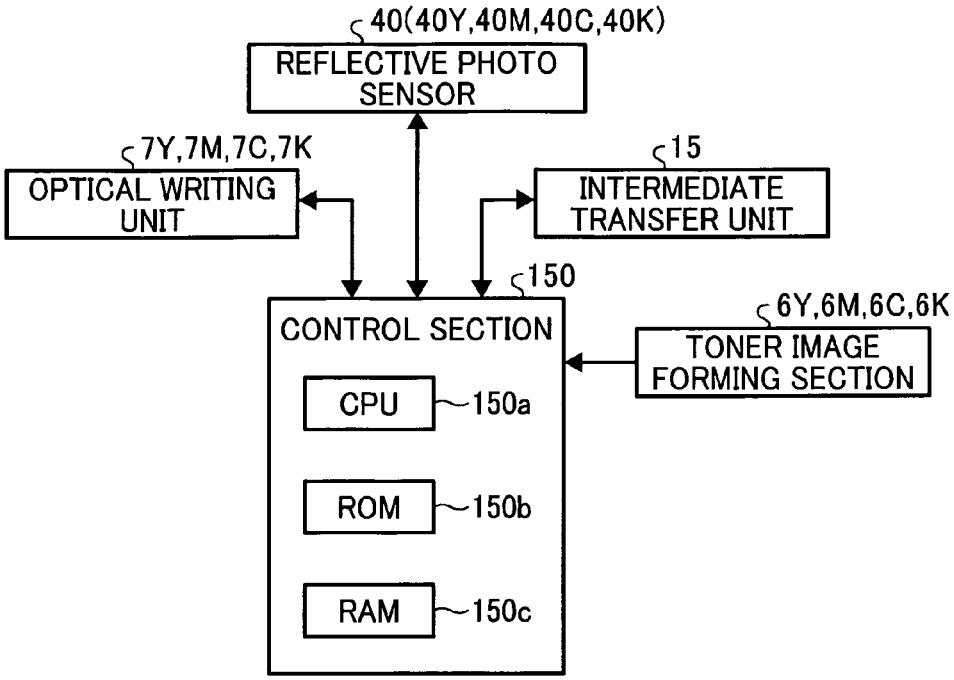
FIG. 3 is a block diagram illustrating the configuration of the control system of the color laser printer.

FIG. 3 is a block diagram illustrating the configuration of a control system for the color laser printer 100 according to the present embodiment. The toner image forming sections 6Y, 6M, 6C, and 6K, the optical writing units 7Y, 7M, 7C, and 7K, the intermediate transfer unit 15, and each of the sensor sections 40Y, 40M, 40C, and 40K in the reflective photo sensor 40, which have been mentioned above, are electrically connected to a control section (controller) 150, which controls their operation. For example, the control section 150 is formed as a microcomputer which includes a CPU 150*a*, a ROM 150*b*, a RAM 150*c*, and an input/output interface, and the CPU 150*a* uses the RAM 150*c* as a work area to execute control programs stored in the ROM 150*b*, thereby controlling the operations of the toner image forming sections 6Y, 6M, 6C, and 6K, the optical writing units 7Y, 7M, 7C, and 7K, the intermediate transfer unit 15, and each of the sensor sections 40Y, 40M, 40C, and 40K in the reflective photo sensor 40.

In particular, the color laser printer 100 according to the present embodiment performs what is called process control, under the control of the control section 150, in the course of which control is provided to adjust the density of images. The process control is conducted with predetermined operational timing, for example, when the main power of the color laser printer 100 is turned on, during standby after a predetermined period of time has elapsed, or during standby after a predetermined number of sheets or more have been printed.

More specifically, when the aforementioned predetermined operational timing has come, the process first performs a calibration of each of the sensor sections 40Y, 40M, 40C, and 40K in the reflective photo sensor 40. This sensor calibration is done in a manner such that the reflective photo sensor 40 is activated with no toner images formed on the intermediate transfer belt 8. Then, while the amount of emission for each of the sensor sections 40Y, 40M, 40C, and 40K in the reflective photo sensor 40 is being sequentially varied, the process determines the amounts of emission at which the respective sensor sections 40Y, 40M, 40C, and 40K have a predetermined sense voltage value. These amounts of emission are stored, for example, in the RAM 150*c* of the control section 150, to be used later for adjusting image density.

Next, while the photosensitive elements 1Y, 1M, 1C, and 1K of the toner image forming sections 6Y, 6M, 6C, and 6K are being rotated, the photosensitive elements 1Y, 1M, 1C, and 1K are electrostatically charged. At this time, unlike uniform electrostatic charging during typical printing (e.g., −700 V), the control section 150 provides control so as to gradually increase the electric potential. Then, under the control of the control section 150, the optical writing units 7Y, 7M, 7C, and 7K scan a laser beam across the surface of the photosensitive elements 1Y, 1M, 1C, and 1K. This scanning allows an electrostatic latent image of a gradation pattern to be formed on the photosensitive elements 1Y, 1M, 1C, and 1K, and then the electrostatic latent image of a gradation pattern is developed by the developing units 5Y, 5M, 5C, and 5K. By this development step, the gradation patterns of respective colors are formed on the respective photosensitive elements 1Y, 1M, 1C, and 1K. Note that in the development step, the control section 150 also provides control to gradually increase (or decrease) the values of the developing bias that are applied to the developing rollers of the respective developing units 5Y, 5M, 5C, and 5K.

In this manner, the gradation patterns Py, Pm, Pc, and Pk of respective colors are formed which each include a plurality of (for example, ten) toner patches at different densities. As shown in FIG. 2, these gradation patterns Py, Pm, Pc, and Pk of respective colors are transferred to positions opposite to the respective sensor sections 40Y, 40M, 40C, and 40K in the reflective photo sensor 40 on the intermediate transfer belt 8 so as not to overlap one another. That is, on the intermediate transfer belt 8, the gradation patterns Py, Pm, Pc, and Pk of respective colors are formed color by color in parallel.

The amounts of reflected lights from the gradation patterns Py, Pm, Pc, and Pk of respective colors that are formed on the intermediate transfer belt 8 are sensed when the intermediate transfer belt 8 passes by the positions opposite to the reflective photo sensor 40 while endlessly traveling. Then, the reflective photo sensor 40 outputs to the control section 150 electric signals depending on the toner patch densities of the respective gradation patterns Py, Pm, Pc, and Pk. On the basis of the output signals which are sequentially delivered from the reflective photo sensor 40, the control section 150 determines the amounts of deposited toners of pluralities of (for example, ten) toner patches in the respective gradation patterns Py, Pm, Pc, and Pk of respective colors. The resulting amounts of deposited toners are stored in the RAM 150*c*. Here, the control section 150 stores the amounts of deposited toners in the RAM 150*c* as well as simultaneously estimates the development potentials from the image forming conditions for the gradation patterns Py, Pm, Pc, and Pk of respective colors. The resulting information on the gradation patterns Py, Pm, Pc, and Pk is also stored in the RAM 150*c*.

The gradation patterns Py, Pm, Pc, and Pk of respective colors that have passed by the position opposite to the reflective photo sensor 40 are cleaned with the aforementioned cleaning devices 10Y, 10M, 10C, and 10K, respectively. Note that the steps mentioned above are not followed sequentially color by color but in parallel for respective colors.

Figure 4:
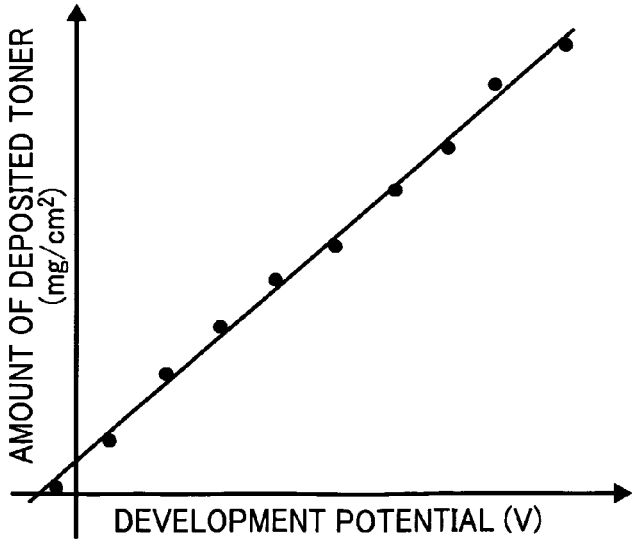
FIG. 4 is a graph showing the relationship between the development potential and the amount of deposited toner at the time of forming each toner patch constituting a gradation pattern.

FIG. 4 is a graphic plot of the relationship between the development potential and the amount of deposited toner on the X-Y plane when each toner patch that constitutes the gradation pattern is formed. In FIG. 4, the X-axis represents the development potential (the difference between the developing bias and the pattern image potential: VB-VL in volts), while the Y-axis represents the amount of deposited toner per unit area (mg/cm$^2$). The control section 150 selects a straight line region from the data points plotted as in FIG. 4, and then calculates a straight line equation for each color by linearly approximating the data points within the region using the least squares method. On the basis of this straight line equation, the controller 150 calculates the development potential at which the target amount of deposited toner can be obtained. Then, the controller 150 adjusts image forming conditions (such as LD power, electrostatic charge bias, developing bias, etc.) so as to realize the development potential, thereby attempting to maintain image density.

Here, to make adequate adjustment of an image density as described above, variations in the development potential, which is performed while the gradation patterns Py, Pm, Pc, and Pk are being formed, need to be accurately followed by the toner density of each toner patch in the formed gradation patterns Py, Pm, Pc, and Pk. In other words, if, on each toner patch of the gradation patterns Py, Pm, Pc, and Pk which are formed while the development potential is being varied, a certain disturbance factor causes unstable density variations which will not follow changes in the development potential, the development potential at which the target amount of deposited toner is provided cannot be properly calculated, and thus stabilized image quality is difficult to be obtained. Such a disturbance factor affecting the adjustment of the density may include the effect of the image history. The image history represents a phenomenon in which variations in image density is caused by fluctuations in the amount of electrostatic charge of toner on the circumferential surface of the developing roller in the developing unit 5Y, 5M, 5C, or 5K.

Figure 5:
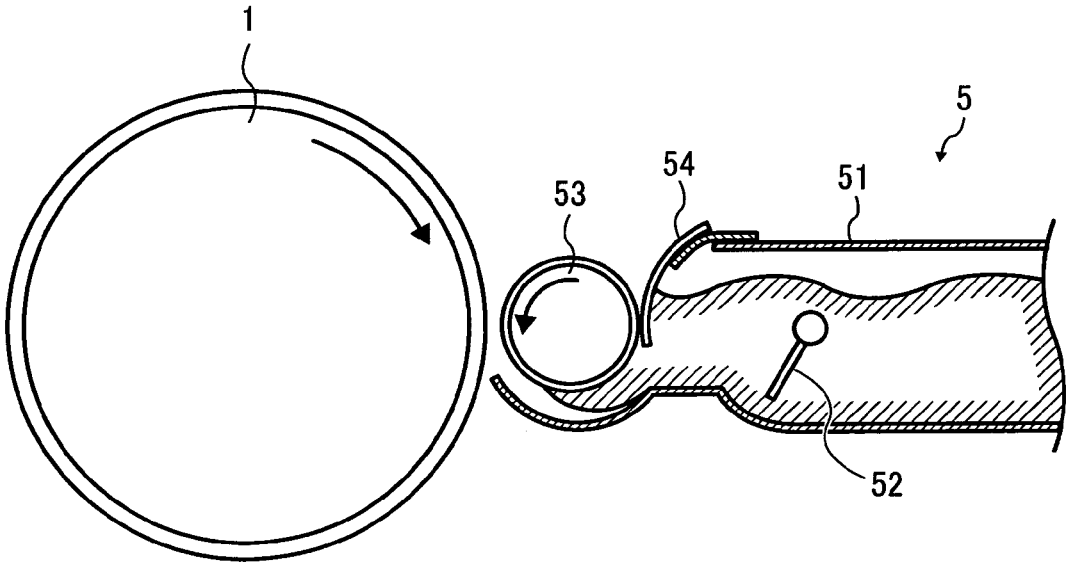
FIG. 5 is a view illustrating a configuration example of a developing unit.

Note that the developing units 5Y, 5M, 5C, and 5K are configured in the same manner only except that they employ developers of different colors. In this context, they will be collectively referred to as the developing unit 5 unless otherwise required to be distinctively referred to. Now, referring to FIG. 5, a description will be made to the phenomenon that is called as the image history. The developing unit 5 shown in FIG. 5 employs a one-component development scheme. The developing unit 5 supplies toner serving as a developer stored within a housing 51 to a developing roller 53 while the toner is being stirred with a toner feed blade 52, and then develops the latent image formed on the photosensitive element 1Y, 1M, 1C, or 1K (hereinafter collectively referred to as the photosensitive element 1 unless otherwise required to be distinctively referenced) with the toner on the circumferential surface of the developing roller 53. The toner on the circumferential surface of the developing roller 53 is stirred and thereby given friction with the toner feed blade 52, and thus electrostatically charged with a predetermined polarity to be then supplied to the developing roller 53. The circumferential surface of the developing roller 53 is in contact with an edge of a trimmer blade 54, and thus the toner layer to be formed on the circumferential surface of the developing roller 53 is restricted with the trimmer blade 54 to a predetermined thickness. At this time, the toner on the circumferential surface of the developing roller 53 is also electrostatically charged to the same polarity by the friction with the trimmer blade 54.

Here, the toner on the circumferential surface of the developing roller 53 is used to develop the latent image formed on the photosensitive element 1. At this time, at a position on the circumferential surface of the developing roller 53 opposite to the position of the photosensitive element 1 at which the latent image is formed, the electrostatically charged toner is consumed by the development. However, at the other positions on the circumferential surface of the developing roller 53, the electrostatically charged toner remains without being consumed. Subsequently, additional toner is supplied with the toner feed blade 52 to the position on the circumferential surface of the developing roller 53 at which toner has been consumed. The new supplied toner is different in the amount of electrostatic charge from the toner remaining on the circumferential surface of the developing roller 53. For example, the toner remaining on the circumferential surface of the developing roller 53 will be increased in the number of times of contacts with the trimmer blade 54 due to the subsequent rotational motion of the developing roller 53. This will cause the remaining toner to be more electrostatically charged than the additionally supplied toner because the former is charged by touching with the trimmer blade 54 by greater number of times. The difference in the amount of toner charge on the circumferential surface of the developing roller 53 will appear as the difference in the amount of deposited toner at the time of the next step of image formation. This will lead to the phenomenon called as the image history in which the effect of the just previously formed image causes variations in the density of the subsequent image.

The above example is directed to a developing unit of one-component development scheme which serves as the developing unit 5. However, the image history will also be found in a developing unit of a two-component development scheme used as the developing unit 5. The two-component development scheme employs a mixture of toner and carrier as the developer, so that the toner will be charged by friction caused by being stirred together with the carrier. Furthermore, the developing unit 5 includes a paddle that supplies the developer to the developing roller 53. Note that the paddle may be, for example, one as disclosed in Japanese Patent No. 4283688. The electrostatically charged toner is supplied to the developing roller 53 through the rotational motion of the paddle, etc. in conjunction with the carrier. Here, the residual toner not consumed in the development step of a latent image on the photosensitive element 1 will be further electrostatically charged when being affected by the counter charge from the photosensitive element 1. In the two-component development scheme, the developer on the circumferential surface of the developing roller 53 which has remained without being consumed in the development step of a latent image on the photosensitive element 1 is stripped off and collected. However, all the developer cannot be collected, so that the developer containing the toner electrostatically charged to a high level remains on the circumferential surface of the developing roller 53. On the other hand, additional developer is supplied to the position at which toner on the circumferential surface of the developing roller has been consumed. However, there will occur a difference in the amount of electrostatic charge between the toner contained in the additionally supplied developer and the toner of the developer remaining on the circumferential surface of the developing roller 53. Thus, as with one-component development scheme, the difference in the amount of toner charge on the circumferential surface of the developing roller 53 will appear as the difference in the amount of deposited toner in the next image formation step, thus causing the effect of the image history.

Figure 6:
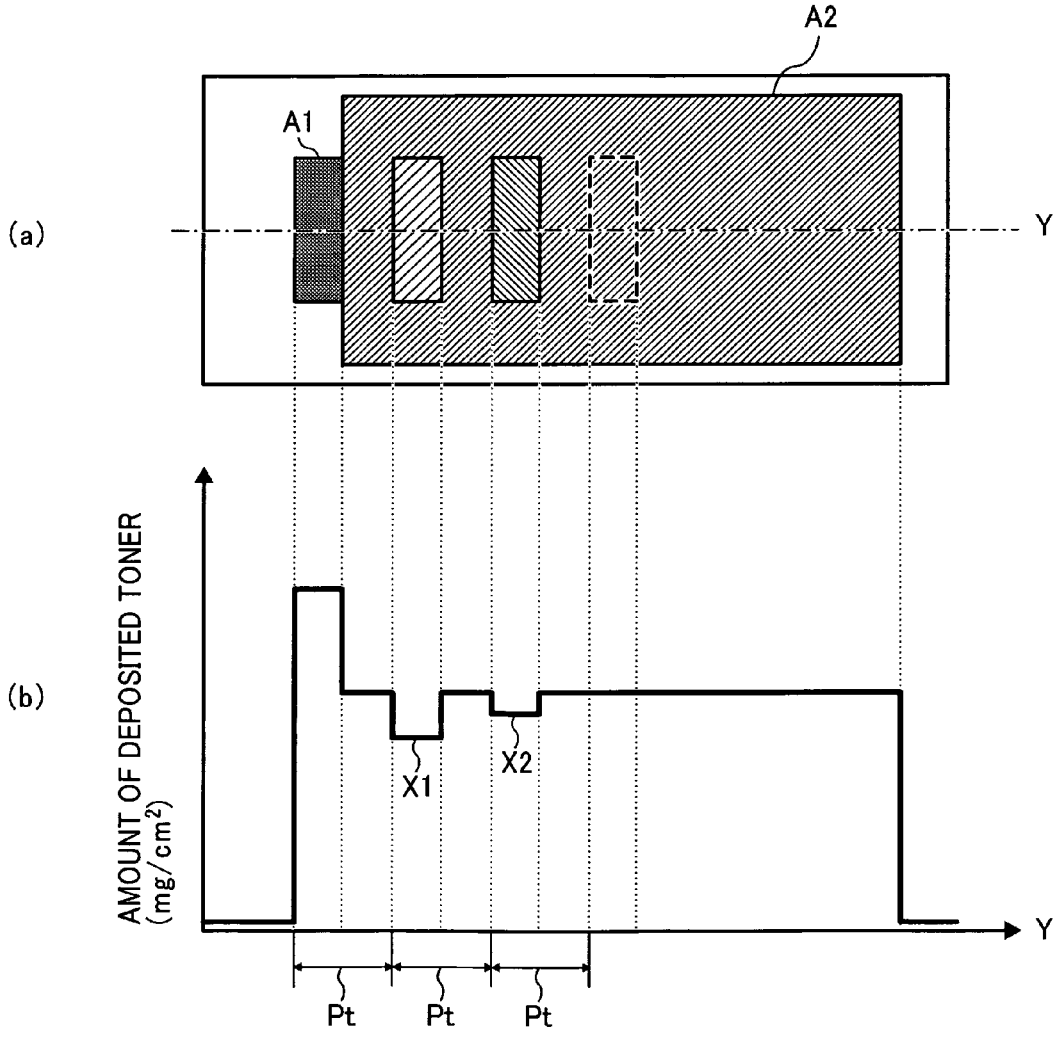
FIG. 6 is an explanatory view illustrating an image history.

Here, an example of the image history will be described with reference to FIG. 6. FIG. 6(*a*) schematically illustrates the image history that occurs when printing a solid image A1 followed by a halftone image A2. FIG. 6(*b*) shows the amount of deposited toner on line Y of FIG. 6(*a*). In FIG. 6(*b*), Pt is the pitch of the developing roller 53 (the length corresponding to the circumference of the developing roller 53), X1 denotes a portion corresponding to the image history provided after the developing roller 53 has rotated once, and X2 denotes a portion corresponding to the image history provided after the developing roller 53 has rotated twice. Here, typically, the ratio of the linear speed of the circumferential surface of the developing roller 53 to the linear surface speed of the photosensitive element 1 (hereinafter referred to as the development linear speed ratio) is not set to 1.0, that is, the linear surface speed of the photosensitive element 1 is set to be different from the linear speed of the circumferential surface of the developing roller 53. Thus, the pitch Pt of the developing roller 53 is obtained by dividing the circumferential length of the developing roller 53 by the development linear speed ratio.

As shown in FIG. 6, printing the solid image A1 followed by the halftone image A2 causes the image history to occur at intervals of the pitch Pt of the developing roller 53 from the position at which the solid image A1 has been printed, which results in the amount of deposited toner of the halftone image A2 being reduced. Furthermore, the image history causes the greatest decrease in the amount of deposited toner of the image history X1 which occurs after the developing roller 53 has rotated once from the image causing the history (the solid image A1 in FIG. 6). Subsequently, every time the developing roller 53 is rotated repeatedly, the level of decrease in the amount of deposited toner caused by the image history is gradually reduced. Note that the example of FIG. 6 illustrates printing of the solid image A1 followed by the halftone image A2. However, printing the solid image instead of the halftone image A2 also causes the image history in the same manner. Here, the image history produced at intervals of the pitch Pt of the developing roller 53 is caused as described above. That is, the amount of electrostatic charge of the toner on the circumferential surface of the developing roller 53 is affected by the toner consumption in the immediately preceding step of image formation. This causes a nonuniform distribution of the amount of toner charge between the position at which the toner has been consumed in the development step and the position at which the toner has remained without being consumed. The image history cannot be completely avoided, though with varying degrees, in a system in which the toner (developer) is supplied to the developing roller 53 and the toner (developer) carried on the developing roller 53 is used to develop images. Thus, the image history occurs regardless of whether the system employs one-component development scheme or the two-component development scheme.

Figure 7:
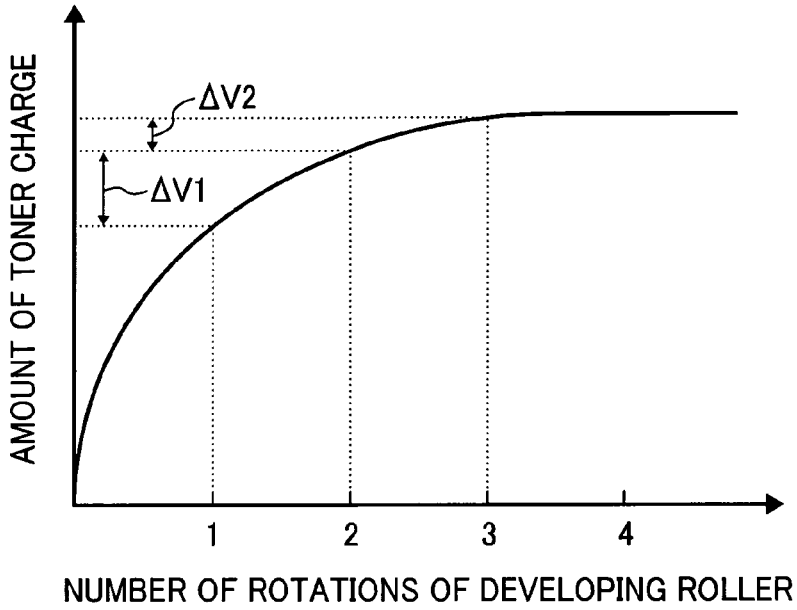
FIG. 7 is a graph showing the relationship between the amount of toner charge at an arbitrary position on the circumferential surface of the developing roller and the number of rotations of the developing roller.

FIG. 7 is a graph showing the relationship between the number of rotations of the developing roller 53 and the amount of toner charge at an arbitrary position on the circumferential surface of the developing roller 53 when the developing roller 53 is rotated without consuming toner. Note that in FIG. 7, the horizontal axis represents the number of rotations of the developing roller 53 and the vertical axis represents the amount of remaining toner charge. As shown in FIG. 7, the amount of toner charge on the circumferential surface of the developing roller 53 increases as the number of rotations of the developing roller 53 increases. However, the amount of toner charge does not increase linearly. As the number of rotations of the developing roller 53 increases, the increase in the amount of toner charge tends to gradually reduce, and then be saturated and approach to zero when a certain amount of electrostatic charge has been reached. For example, the amount of increase in toner charge ΔV2 during an increase in the number of rotations of the developing roller 53 from two to three rotations is less than the amount of increase in toner charge ΔV1 during an increase in the number of rotations of the developing roller 53 from one to two rotations.

As described above, the image history is the phenomenon in which the difference in the amount of electrostatic charge between the toner new supplied in place of the toner consumed in the development step and the toner remaining without having been consumed appears as the difference in the amount of deposited toner, thereby causing variations in image density. Thus, by rotating the developing roller 53 for a predetermined period without consuming the toner (i.e., without forming images) after toner at a certain portion has been consumed in the development step, the difference in the amount of electrostatic charge between the new supplied toner and the remaining toner can be reduced, which results in the effect of the image history being lessened. Here, to form the gradation patterns Py, Pm, Pc, and Pk that are used for making adjustment of the image density, the image history does not need to be completely zero. Rather, in view of the accuracy of detection of the amount of deposited toner and other variation factors of the gradation patterns Py, Pm, Pc, and Pk (for example, variations of development gap in the circumferential direction), if the effect of the image history can thus be restricted to be below a certain acceptable level, then the stability of the adjustment of the image density will not be substantially affected. That is, by widening each interval between toner patches to a certain extent when forming each toner patch of the gradation patterns Py, Pm, Pc, and Pk, the effect of the image history can be reduced to an acceptable level and thereby adequate adjustment of the image density can be made.

Therefore, the color laser printer 100 according to the present embodiment is configured to cause the four toner image forming sections 6Y, 6M, 6C, and 6K to form the gradation patterns Py, Pm, Pc, and Pk of respective colors on the intermediate transfer belt 8 under the control of the control section 150 in a manner such that each interval between the toner patches in each of the gradation patterns Py, Pm, Pc, and Pk is equal to or greater than the length corresponding to the circumference of the developing roller 53 (=the pitch Pt of the developing roller 53=the circumferential length of the developing roller 53/the development linear speed ratio).

Figure 8:
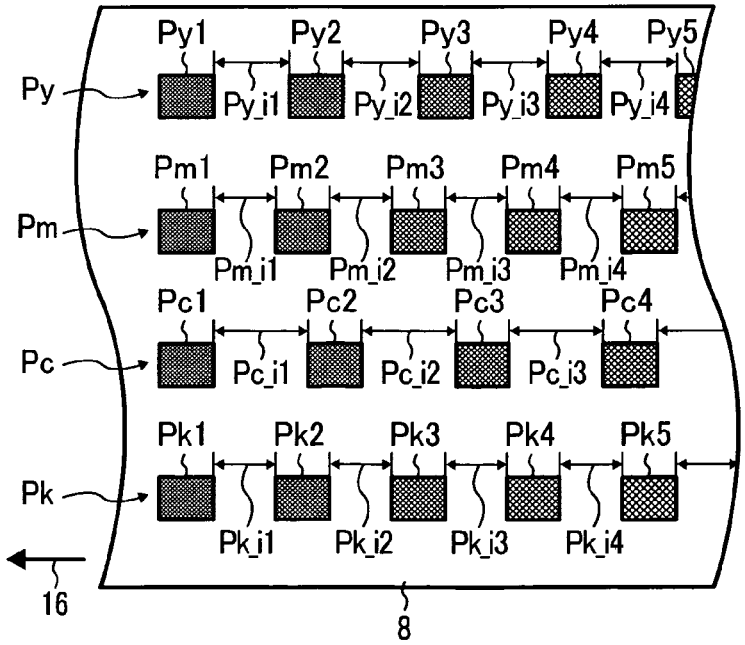
FIG. 8 is a view illustrating an example of a gradation pattern of each color formed on an intermediate transfer belt.

FIG. 8 illustrates an example of the gradation patterns Py, Pm, Pc, and Pk of respective colors to be formed on the intermediate transfer belt 8 in the color laser printer 100 according to the present embodiment. The Y gradation pattern Py is formed such that a plurality of toner patches are arranged at intervals in the travelling direction of the intermediate transfer belt 8 (in the direction of the arrow 16 in the figure), so as to form an array of Py1, Py2, Py3, Py4, Py5, . . . , in the order of decreasing amount of toner deposited on the toner patches (in descending order of density). In this time, the interval between the toner patches Py1 and Py2 (Py_i1), the interval between the toner patches Py2 and Py3 (Py_i2), the interval between the toner patches Py3 and Py4 (Py_i3), the interval between the toner patches Py4 and Py5 (Py_i4), . . . are each set to be equal to or greater than the length corresponding to the circumference of the developing roller 53.

Likewise, the M gradation pattern Pm is formed such that a plurality of toner patches are arranged at intervals in the travelling direction of the intermediate transfer belt 8, so as to form an array of Pm1, Pm2, Pm3, Pm4, Pm5, . . . , in decreasing order of the amount of toner deposited on the toner patches. In this time, the interval between the toner patches Pm1 and Pm2 (Pm_i1), the interval between the toner patches Pm2 and Pm3 (Pm_i2), the interval between the toner patches Pm3 and Pm4 (Pm_i3), the interval between the toner patches Pm4 and Pm5 (Pm_i4), . . . are each set to be equal to or greater than the length equivalent to the circumference of the developing roller 53.

Likewise, the C gradation pattern Pc is formed such that a plurality of toner patches are arranged at intervals in the travelling direction of the intermediate transfer belt 8, so as to form an array of Pc1, Pc2, Pc3, Pc4, . . . , in decreasing order of the amount of toner deposited on the toner patches. In this time, the interval between the toner patches Pc1 and Pc2 (Pc_i1), the interval between the toner patches Pc2 and Pc3 (Pc_i2), the interval between the toner patches Pc3 and Pc4 (Pc_i3), . . . are each set to be equal to or greater than the length equivalent to the circumference of the developing roller 53.

Likewise, the K gradation pattern Pk is formed such that a plurality of toner patches are arranged at intervals in the travelling direction of the intermediate transfer belt 8, so as to form an array of Pk1, Pk2, Pk3, Pk4, Pk5, . . . , in decreasing order of the amount of toner deposited on the toner patches. In this time, the interval between the toner patches Pk1 and Pk2 (Pk_i1), the interval between the toner patches Pk2 and Pk3 (Pk_i2), the interval between the toner patches Pk3 and Pk4 (Pk_i3), the interval between the toner patches Pk4 and Pk5 (Pk_i4), . . . , are each set to be equal to or greater than the length equivalent to the circumference of the developing roller 53.

As described above, the color laser printer 100 according to the present embodiment is configured to form the gradation patterns Py, Pm, Pc, and Pk used for adjusting image density such that each interval between the toner patches is equal to or greater than the length corresponding to the circumference of the developing roller 53. This ensures that, after the formation of a preceding toner patch, the subsequent toner patch will never be formed within the distance range corresponding to the circumference of the developing roller 53 in which the image history of the preceding toner patch has the most serious effects. Thus, there will be a higher probability that the effect of the image history on the gradation patterns Py, Pm, Pc, and Pk can be reduced below the aforementioned acceptable level. It is thus possible to effectively eliminate the problem that the density of each toner patch (the amount of deposited toner) of the gradation patterns Py, Pm, Pc, and Pk cannot be detected accurately due to the effect of the image history, and thereby the adjustment of the image density is made unstable. As a result, the adjustments of the image density can be appropriately carried out.

Now, suppose that the length of each toner patch constituting the gradation patterns Py, Pm, Pc, and Pk (or a length of the toner patch in a sub-scanning direction parallel to the travelling direction of the intermediate transfer belt 8) is sufficiently short relative to the circumferential length of the developing roller 53, and a plurality of toner patches can be formed while the developing roller 53 rotates once. In this case, every time the developing roller 53 makes one rotation, the positions of a plurality of toner patches can be shifted to another positions at which the image history caused by the plurality of toner patches formed in the previous rotation of the developing roller 53 will have no effect. This conceivably makes it possible to reduce the interval between the toner patches. However, to appropriately shift the positions of the plurality of toner patches each time the developing roller 53 rotates once, complex control is required, and this is not realistic.

Furthermore, in practice, the length of each toner patch constituting the gradation patterns Py, Pm, Pc, and Pk is often equal to or greater than half the circumferential length of the developing roller 53. This is because a shorter length of a toner patch causes the reflective photo sensor 40 to be unable to ensure a sufficient number of sampling points, so that the amount of deposited toner on each toner patch cannot be detected with accuracy. In particular, recent color laser printers are configured to be capable of printing at high speeds and thus the intermediate transfer belt 8 tends to travel at higher speeds. This requires the length of each toner patch constituting the gradation patterns Py, Pm, Pc, and Pk to be sufficiently long.

Figure 9:
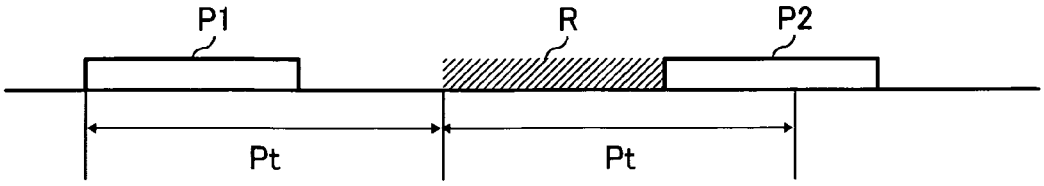
FIG. 9 is a schematic view illustrating how to form a subsequent toner patch at such a position on which the image history of a preceding toner patch has no effect.

In a case in which the length of each toner patch constituting the gradation patterns Py, Pm, Pc, and Pk may be equal to or greater than half the circumferential length of the developing roller 53, as shown in FIG. 9, the area on which the image history of the preceding toner patch P1 has the most serious effect is the region R in the figure. To form the next toner patch P2 outside the region R, the toner patch P2 has to be formed after the region R. Thus, the interval between the toner patch P1 and the toner patch P2 should be equal to or greater than the length corresponding to the circumference of the developing roller 53. Note that Pt in the figure is the pitch of the developing roller 53 (the length corresponding to the circumference of the developing roller 53). From the discussions above, the color laser printer 100 according to the present embodiment is configured such that the minimum value of each interval between the toner patches constituting each of the gradation patterns Py, Pm, Pc, and Pk is set to the length corresponding to the circumference of the developing roller 53, and is configured to form the gradation patterns Py, Pm, Pc, and Pk used for making adjustment of the image density such that each interval between the toner patches is equal to or greater than the length corresponding to the circumference of the developing roller 53.

As described above, the color laser printer 100 according to the present embodiment is configured to allow for making appropriate adjustment of the image density with stability, by causing each interval between the toner patches of the gradation patterns Py, Pm, Pc, and Pk used for making adjustment of the image density to be equal to or greater than the length corresponding to the circumference of the developing roller 53. However, an increase in each interval between the toner patches accordingly requires more time to completely detect the density of all toner patches. To reduce this time, each interval between the toner patches is more preferably equal to the length corresponding to the circumference of the developing roller 53. Note that as described above, the color laser printer 100 according to the present embodiment is configured such that the reflective photo sensor 40 is provided with the sensor sections 40Y, 40M, 40C, and 40K for the respective colors, and the gradation patterns Py, Pm, Pc, and Pk of respective colors are arranged in parallel on the intermediate transfer belt 8, and the density of the toner patch of the gradation patterns Py, Pm, Pc, and Pk of respective colors are detected in parallel (simultaneously) between the colors.

When, for example, the density of the toner patches of the gradation patterns Py, Pm, Pc, and Pk of respective colors is detected sequentially between the colors, the effect of an increase in detection time resulting from an increase in the intervals between toner patches is equal to an increased length of the interval between toner patches×(the number of toner patches per one color−1)×four (colors). On the other hand, when the density of the toner patches of the gradation patterns Py, Pm, Pc, and Pk of respective colors is detected in parallel between the colors. In this case, the effect of an increase in detection time resulting from an increase in the intervals between toner patches is equal to an increased length of the interval between toner patches×(the number of toner patches per one color−1), which is reduced one fourth of that in the case of the sequential detection.

This shows that, to reduce the effect of the image history below the aforementioned acceptable level, each interval between the toner patches of each of the gradation patterns Py, Pm, Pc, and Pk has to be at least equal to or greater than the length corresponding to the circumference of the developing roller 53. Further, in practice, the intervals between toner patches which ensure the reduction of the effect of the image history below the acceptable level depends on various factors such as conditions for forming each toner patch, and also depends on the difference in color of the toner patches. Therefore, the intervals between the toner patches of each of the gradation patterns Py, Pm, Pc, and Pk is preferably determined not in common for all the colors but for each individual color. This causes the effect of an increase in detection time resulting from the provision of the interval between toner patches to be determined by the gradation pattern of one of the four colors which has the greatest interval between toner patches. It is thus possible to suppress an increase in downtime when compared with the case where the common interval between toner patches is defined for the gradation patterns Py, Pm, Pc, and Pk of respective colors under assumption of the worst conditions.

Figure 10:
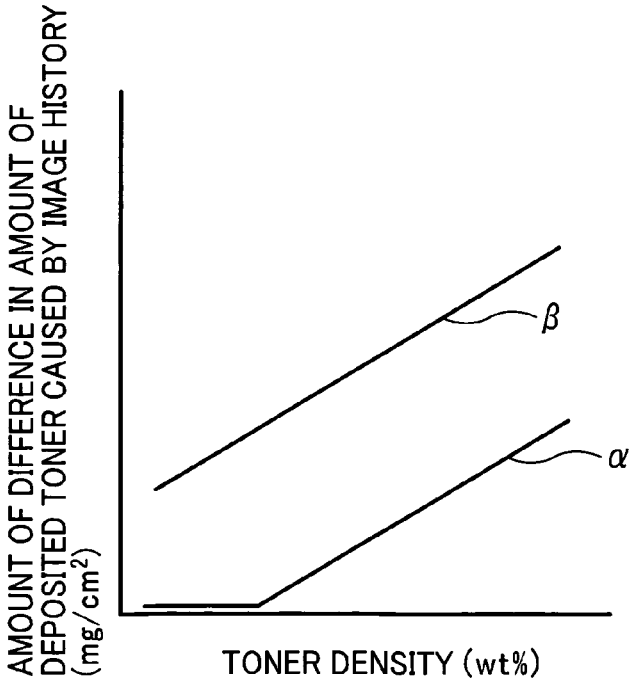
FIG. 10 is a view illustrating the relationship between the toner density and the using time of a developer and a level of the effect of the image history.

When a developing unit of the two-component development scheme type is employed as the developing unit 5, the level of the effect of the image history may also vary depending on the toner density of the developer (the content rate of the toner in the developer). As shown in FIG. 10, the level of the effect of the image history tends to increase as the toner density of the developer increases. Note that the horizontal axis of FIG. 10 represents the toner density (wt %) of a two-component developer, while the vertical axis represents the level of the effect of the image history (the amount of change in the amount of deposited toner). Taking such characteristics of the image history into account, each interval between the toner patches of the gradation patterns Py, Pm, Pc, and Pk is preferably determined according to the toner density of the developer currently used in the developing unit 5 so that the effect of the image history falls below the aforementioned acceptable level.

Furthermore, as shown in FIG. 10, the level of the effect of the image history is greater when an aged developer with reduced flowability is used than when a new developer is used for the first time. In FIG. 10, α denotes a line showing the characteristic of a new developer and β denotes a line showing the characteristic of an aged developer nearing the end of its useful service life. Taking such characteristics of the image history into account, each interval between the toner patches of each of the gradation patterns Py, Pm, Pc, and Pk is preferably determined in a manner such that the effect of the image history falls below the aforementioned acceptable level depending on the using time of the developer currently used in the developing unit 5 (the total driving time of the developing unit 5 or the total number of printed sheets from the time of replacement with the new developer). However, each interval between the toner patches needs to be equal to or greater than the length corresponding to the circumference of the developing roller.

Figure 11:
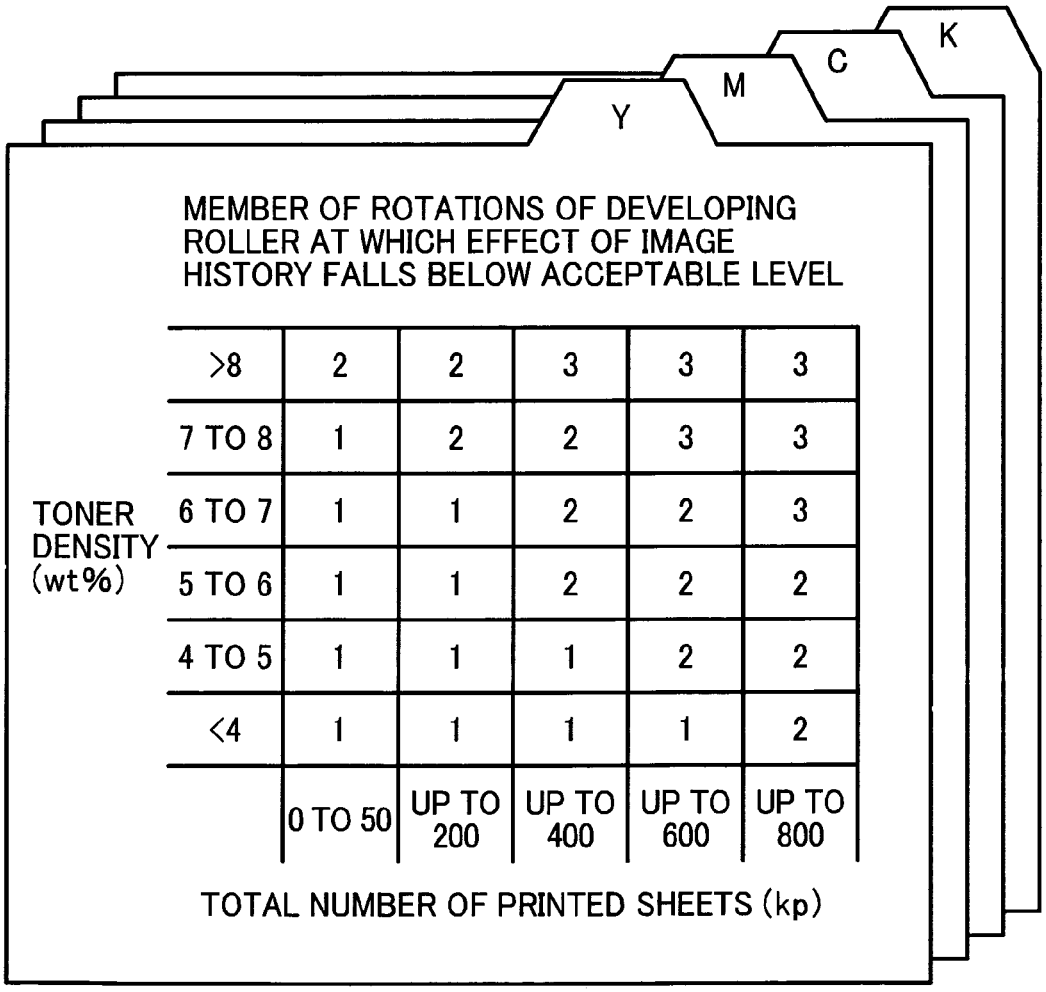
FIG. 11 is a view illustrating an example data table which is used to determine the interval between each toner patch of a gradation pattern on the basis of the developer toner density and the using time of the developer.

Possible specific ways of determining each interval between the toner patches of each of the gradation patterns Py, Pm, Pc, and Pk on the basis of the toner density of the developer or the using time of the developer includes the following. That is, in one of such ways, the characteristics of the image history as shown in FIG. 10, i.e., the toner density of the developer used in the developing unit 5 and the using time of the developer (for example, the total number of printed sheets from the time of replacement with the new developer) is compared with the level of the image history. Then, for each of conditions of the different toner densities and the different using times of the developer, the number of rotations of the developing roller 53 at which the effect of the image history falls below the acceptable level is pre-determined, and is then stored as the data table for each color as shown in FIG. 11. Then, prior to forming the gradation patterns Py, Pm, Pc, and Pk, for example, the toner density sensor included in the developing unit 5 is used to detect the toner density of the developer. Additionally, the control section 150 acquires information such as the total number of sheets printed using the developing unit 5 from the time of replacement with the new developer and then references the aforementioned data table. The control section 150 thereby recognizes the number of rotations of the developing roller 53 at which the effect of the image history falls below the acceptable level. Then, on the basis of the number of rotations of the developing roller 53 at which the effect of the image history falls below the acceptable level, each interval between toner patches of each of the gradation patterns Py, Pm, Pc, and Pk is determined independently color by color. Even in the presence of changes in the state of the developer due to aging or environmental variations, this makes it possible to effectively reduce the effect of the image history to thereby make adequate adjustment of the image density.

Furthermore, the level of the image history increases as a density of the image that causes the image history increases (the amount of deposited toner increases), causing a tendency to increase the number of rotations of the developing roller 53 at which the effect of the image history falls below the acceptable level. Therefore, each interval between the toner patches of each of the gradation patterns Py, Pm, Pc, and Pk should not be set to the same value but is preferably determined in a manner such that as the amount of toner deposited on a just previously formed toner patch becomes less, the interval between that toner patch and the subsequent toner patch is reduced. That is, of toner patches of each of the gradation patterns Py, Pm, Pc, and Pk, the interval between an nth formed toner patch and an (n+1)th formed toner patch (n is a natural number) is preferably determined on the basis of the density of the nth formed toner patch so that the interval is reduced as the density of the nth toner patch becomes less (the amount of deposited toner is reduced).

More specifically, for instance, in the example shown in FIG. 8, the interval Py_i2 between the toner patches Py2 and Py3 of the Y gradation pattern Py is made less than the interval Py_i1 between the toner patches Py1 and Py2. The interval Py_i3 between the toner patches Py3 and Py4 is made less than the interval Py_i2 between the toner patches Py2 and Py3. Likewise, the interval Pm_i2 between the toner patches Pm2 and Pm3 of the M gradation pattern Pm is made less than the interval Pm_i1 between the toner patches Pm1 and Pm2. The interval Pm_i3 between the toner patches Pm3 and Pm4 is made less than the interval Pm_i2 between the toner patches Pm2 and Pm3. Likewise, the interval Pc_i2 between the toner patches Pc2 and Pc3 of the C gradation pattern Pc is made less than the interval Pc_i1 between the toner patches Pc1 and Pc2. The interval Pc_i3 between the toner patches Pc3 and Pc4 is made less than the interval Pc_i2 between the toner patches Pc2 and Pc3. Likewise, the interval Pk_i2 between the toner patches Pk2 and Pk3 of the K gradation pattern Pk is made less than the interval Pk_i1 between the toner patches Pk1 and Pk2. The interval Pk_i3 between the toner patches Pk3 and Pk4 is made less than the interval Pk_i2 between the toner patches Pk2 and Pk3. This allows for effectively reducing the effect of the image history to thereby stably make proper adjustment of the image density.

As have been described with reference to specific examples, the color laser printer 100 according to the present embodiment makes adjustment of the image density with predetermined operational timing. In this adjustment, the gradation patterns Py, Pm, Pc, and Pk of respective colors used for making adjustment of the image density are formed on the intermediate transfer belt 8 so that each interval between toner patches is equal to or greater than the length corresponding to the circumference of the developing roller 53. Therefore, the color laser printer 100 solves the problem of the conventional technique that the defective toner removal image is formed in order to eliminate the effects of the image history. That is, without causing an increase in running costs due to wasted consumption of toner, the color laser printer 100 can effectively reduce the effect of the image history to thereby make appropriate adjustment of the image density and provide stable image quality.

The present invention has been described with reference to a specific embodiment. However, the invention is not limited to this specific embodiment but a variety of changes and modifications may be made thereto in practice without deviating from the true scope and spirit of the invention as specified in the appended claims. For example, the aforementioned embodiment is an example in which the present invention is applied to the color laser printer 100 of the tandem scheme. However, the present invention is not limited to the color laser printer 100 illustrated as the aforementioned embodiment but may also be effectively applicable to any image forming apparatuses which function to form a gradation pattern of the plurality of toner patches at different densities on an image carrier and detect the density of each toner patch of the gradation pattern, thereby making adjustment of conditions of image forming based on the detected density value.

The present invention can effectively reduce the effect of the image history without any waste of toner and make adequate adjustment of the image density to provide stable image quality.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus comprising:

an image forming unit that includes a developing unit with a developing roller to form an image using toner;

a controller; and a detection unit that detects a plurality of toner patches formed at different densities on an image carrier by the image forming unit, wherein the controller controls the image forming unit to form the toner patches on the image carrier so that each interval between the toner patches that are adjacent to each other is equal to or greater than a length corresponding to a circumference length of the developing roller.

2. The image forming apparatus according to claim 1, wherein the controller determines each interval between the toner patches on the basis of a toner density of a developer used in the developing unit.

3. The image forming apparatus according to claim 1, wherein the controller determines each interval between the toner patches on the basis of using time of the developer employed in the developing unit.

4. The image forming apparatus according to claim 1, wherein:

the controller causes the image forming units to form the toner patches of a plurality of colors in parallel color by color on the image carrier, and the detection unit includes a plurality of detecting sections for the formed toner patches of the colors, the detecting sections detecting densities of the toner patches of the colors in parallel.

5. The image forming apparatus according to claim 4, wherein the controller determines each interval between each toner patches color by color.

6. The image forming apparatus according to claim 1, wherein the controller determines an interval between an nth formed toner patch and an (n+1)th formed toner patch (n is a natural number) of the toner patches formed on the image carrier by the image forming unit, on the basis of a density of the nth formed toner patch.

7. The image forming apparatus according to claim 6, wherein the controller controls an interval between an nth formed toner patch and an (n+1)th formed toner patch (n is a natural number) of the toner patches formed on the image carrier by the image forming unit, in a manner such that the interval is reduced as an amount of toner deposited on the nth toner patch decreases.

8. An image forming method comprising:

causing, by a controller, an image forming unit to form a plurality of toner patches at different densities on an image carrier, the image forming unit including a developing unit with a developing roller to form an image using toner; and causing, by the controller, a detection unit to detect the toner patches formed on the image carrier by the image forming unit, wherein the controller causes the image forming unit to form the toner patches on the image carrier so that each interval between the toner patches that are adjacent to each other is equal to or greater than a length corresponding to a circumference length of the developing roller.

9. The image forming apparatus according to claim 1, wherein the interval is a space without a patch.

10. The image forming apparatus according to claim 1, wherein the plurality of toner patches constitute an image density adjustment gradation pattern.

* * * * *